United States Patent [19]

Shimojo et al.

[11] Patent Number: 4,822,188

[45] Date of Patent: Apr. 18, 1989

[54] PRINTING MECHANISM

[75] Inventors: Tetsuji Shimojo; Mineo Harada, both of Owariasahi; Hideyo Tanaka, Seto; Kaname Furuya, Kasugai, all of Japan

[73] Assignee: Hitachi, Ltd., Tokyo, Japan

[21] Appl. No.: 931,873

[22] Filed: Nov. 17, 1986

Related U.S. Application Data

[63] Continuation of Ser. No. 700,129, Feb. 11, 1985, abandoned.

[30] Foreign Application Priority Data

Feb. 22, 1984 [JP] Japan ..... 59-30218

[51] Int. Cl.[4] ..... B41J 3/04

[52] U.S. Cl. ..... 400/124; 101/93.05; 400/157.2

[58] Field of Search ..... 400/124, 124 IW, 124 TC, 400/124 VI, 124 WD, 157.2; 101/93.04, 93.05, 93.29, 93.32, 93.33, 93.34, 93.42, 93.48; 335/276, 279

[56] References Cited

U.S. PATENT DOCUMENTS

| | | | |
|---|---|---|---|
| 4,049,107 | 9/1977 | Murat | 101/93.05 X |
| 4,348,120 | 9/1982 | Isobe et al. | 400/124 |
| 4,503,768 | 3/1985 | Whitaker | 101/93.04 |
| 4,511,269 | 4/1985 | Takahashi et al. | 400/124 |
| 4,537,520 | 8/1985 | Ochiai et al. | 101/93.05 X |
| 4,569,605 | 2/1986 | Meier et al. | 101/93.05 X |

FOREIGN PATENT DOCUMENTS

| | | | |
|---|---|---|---|
| 2126306 | 12/1972 | Fed. Rep. of Germany | 335/279 |
| 177374 | 10/1983 | Japan | 101/93.05 |
| 215364 | 12/1983 | Japan | 101/93.05 |

*Primary Examiner*—Charles A. Pearson

*Attorney, Agent, or Firm*—Fay, Sharpe, Beall, Fagan, Minnich & McKee

[57] ABSTRACT

There is disclosed an improvement upon a cancellation type printing mechanism or a stored energy type printing mechanism having magnetic members, so-called armatures, attracted by a permanent magnet while resiliently deflecting resilient members connected to one end thereof. The magnetic members are associated with corresponding electro-magnets which are adapted to be energized selectively to release the associated magnetic members by cancelling the magnetic attracting force of the permanent magnet, so that the magnetic member is actuated by the energy stored in the corresponding resilient members thereby to drive the printing elements. One end of the magnetic member contacts the magnetic pole surface of the permanent magnet or a yoke mounted on the permanent magnet so as to form a fulcrum for the rotation of the magnetic member. A recess is formed on one side of the magnetic member facing a core of the electro-magnet, so that the magnetic member does not engage the corner of the core of the electro-magnet. According to this construction, the magnetic member is prevented from striking against the corner of the core.

18 Claims, 1 Drawing Sheet

PRINTING MECHANISM

This application is a continuation of application Ser. No. 700,129, filed 2/11/85, now abandoned.

BACKGROUND OF THE INVENTION

The present invention relates to a print mechanism and, more particularly, to an armature construction of a wire matrix print head.

Among various wire matrix print heads, a cancellation type and stored energy type print heads as shown in the specification of U.S. Pat. No. 4,225,250 are known. In these types of wire matrix print heads, resilient members are fixed at one end and are flexed by associated permanent magnets. In operation, the attraction force of the permanent magnet is cancelled by the magnetic flux produced by an electro-magnet so that the strain energy stored in the resilient member is released to drive the wire stylus to impact on a paper. This type of print head is superior to other types, such as the clapper type in many respects. Therefore, the wire matrix print head of the cancellation type has come into common use in recent years.

SUMMARY OF THE INVENTION

The assignee has already proposed an improved printing head in the specification of U.S. patent application Ser. No. 480,788 filed Mar. 31, 1983.

According to the print head shown in the above-mentioned specification, since a core of an electro-magnet is expanded by heat while printing, a magnetic surface ("a first magnetic surface") of the core tends to become relatively higher than a magnetic surface ("a second magnetic surface") of a yoke which is mounted on a permanent magnet. As a result, the attraction surface of the armature is damaged and worn by striking the armature against the corner of the core of the electro-magnet when the armature is attracted by the permanent magnet. In addition, the attraction force of the armature decreases and the time for returning the armature to a predetermined position is delayed after a printing element impacts against the paper because of the wear.

An object of the present invention is to provide an armature actuating mechanism which prevents an armature from striking a corner of a core of an electro-magnet.

Another object of the invention is to provide an armature actuating mechanism which does not decrease the attraction force between the armature and a permanent magnet.

Another object of the invention is to provide an armature actuating mechanism having a single predetermined fulcrum for rotating the armature about the actuating mechanism.

A printing mechanism of this invention includes a magnetic member used as an armature for actuating a printing element, a resilient member fixed on one end of the magnetic member for storing potential energy, a permanent magnet for attracting the magnetic member, a yoke mounted adjacent the permanent magnet, and an electro-magnet having a core and a coil around the core for cancelling the attraction force generated by the permanent magnet. The magnetic member is rotatable by the force stored in the resilient member around a predetermined fulcrum, for instance while the fulcrum of rotation of the magnetic member is formed on the second magnetic surface when the attraction force is cancelled by the magnetic flux produced by the electro-magnet.

The magnetic member has a first portion and a second portion. The first portion forms a surface, preferably a flat surface engaging the first magnetic surface when the magnetic member is not actuated. The second portion forms a recessed surface not engaging an edge around the first magnetic surface, especially a near corner to the fulcrum, when the magnetic member is not actuated.

When the first magnetic surface is located in a common plane with the second magnetic surface of the yoke, it is preferred that the magnetic member have a third portion engaging the second magnetic surface of the yoke. In this case, the surface of the first portion facing the core and the surface of the third portion are normally at the same level and define a common plane.

According to the above structure, the armature is prevented from striking the corner of the core when the armature returns to an initial position. In addition, wear between the core and the armature is further prevented by forming a sloped side wall of the recess of the second portion.

A wire matrix printing head is constructed by assembling a plurality of printing mechanisms arranged radially at one end of each of the armatures.

Accordingly, another object of the invention is to provide a wire matrix printing head in which attraction force of each armature may be increased and shortened by the time for returning each armature to a predetermined position.

These and other objects, features and advantages of this invention will become clear from the following description of the preferred embodiment in conjunction with the accompanying drawings.

DESCRIPTION OF THE PREFERRED EMBODIMENTS

The preferred embodiment of the invention is applied in a wire matrix printing head having a plurality of wire styli as the printing element. Seven or nine wire styli are usually enough for printing the alphabet and numerals. On the other hand, a greater number of dots is required, as, for example, 16 or 24 wire styli, when printing the particular Japanese characters called Kanji.

Figure 1:
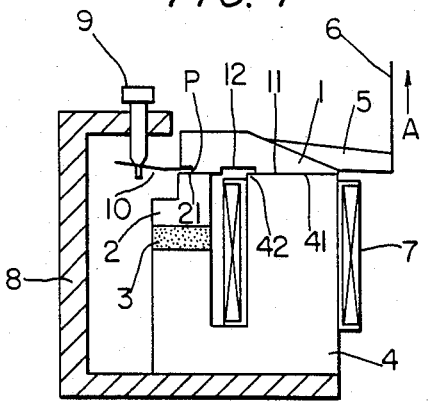
FIG. 1 is a side elevational view of a wire matrix printing head embodying the present invention.

FIG. 1 shows a side elevational view of a cancellation type wire matrix printing head embodying the present invention. Referring to this figure, one end of armature 1, that is the magnetic member, is fixed to an end of lever member 5. The material of the lever member 5 is, for instance, stainless steel to make it light weight. A wire stylus 6 is fixed to another end of the lever member 5 by soldering, for instance. Another end of the armature 1 is fixed to one end of leaf spring 10 as the resilient member by soldering, for instance. Another end of the leaf spring 10 is engaged with screw 9. Screw 9 is rotatably inserted through housing 8 of the printing head. The amount of deflection of the leaf spring 10 may be adjusted by rotating the screw 9. If adjustment of the deflection is unnecessary, screw 9 is unnecessary and it is enough to fix another end of the leaf spring to the housing 8.

A magnetic circuit is constructed so as to face the magnetic surface of the armature 1 for actuating it. The magnetic circuit is composed as follows. A coil 7 (shown in cross-section) is wound around the core 4. The coil 7 and the core 4 compose an electromagnet. A permanent 3 is mounted on one side of the core 4 which is L-shaped. A yoke 2 is mounted on the permanent magnet 3. In the above arrangement, the magnetic surface 41 of the core 4 is preferably the same height as the magnetic surface 21 of the yoke 2.

According to this arrangement, in the normal state of operation, the armature 1 is attracted to the magnetic surface 21 of the yoke 2 by the magnetic force produced by the permanent magnet 3. As a result, the leaf spring 10 is resiliently deflected to store the energy. The amount of deflection is adjustable by the depth of insertion of the screw 9 mentioned previously.

As electric current is supplied to the coil 7 in the described manner, a magnetic field is generated around the core 4 to cancel the magnetic flux of the permanent magnet 3. As a consequence, the armature 1 is made to rotate around the fulcrum formed by the corner P thereof, by the force of the leaf spring 10. The wire stylus 6 is moved in the direction of arrow A to impact on paper, thereby printing a dot which is a constituent of the character. The armature 1 is returned to the position where it was before by the force produced by the permanent magnet 3 after the wire stylus 6 impacts a paper.

According to the subject invention, the construction of the armature 1 and its relation to other parts are characterized as follows.

Figure 2:
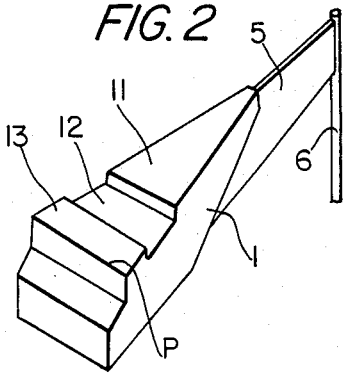
FIG. 2 is a perspective view of an armature shown in FIG. 1.
Figure 3:
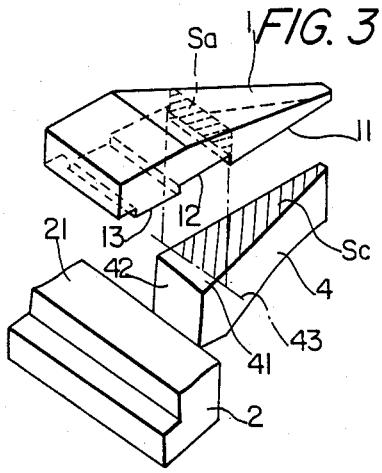
FIG. 3 is an exploded perspective view of an armature and a yoke.

As shown in FIG. 2 and FIG. 3, a recess 12, referred to as a second member surface, is formed on the magnetic surface of the armature 1, which surface faces one end region of the magnetic surface 41 of core 4. More especially, the magnetic surface 11, as a first member surface of the armature 1 faces and engages with the magnetic surface 41 of core 4. The magnetic surface 13, as a third member surface faces and engages the magnetic surface 21 of yoke 2.

To assemble a wire matrix printing head, a plurality of the above printing mechanisms are usually arranged in a circular configuration with each wire stylus 6 extending axially from the end of each armature. A cross-section of each core 4 is preferably formed as a wedge. In this case, the recess 12 partially covers one side of the wedge.

Since the recess 12 covers the corner 42 of the core nearest to the yoke 2, the magnetic surface of the recess 12 does not contact the corner 42 of core 4 although the magnetic surface 11 contacts the magnetic surface 41 of core 4 when the armature 1 is attracted by the force produced by the permanent magnet 3. Referring to the depth of the recess 12, it is preferred that area of the vertical cross-section Sa be greater than the surface area Sc which is provided by the line 43 corresponding to the adjacent surface 11 of the armature 1. As far as any vertical section Sa of the recess 12 satisfies the above condition, the attraction force is prevented from decreasing.

According to the embodiment above mentioned, even though the magnetic surface 41 of core 4 rises higher than the level of magnetic surface 21 of yoke 2 because of the expansion of the core 4 when heated by coil 7 during printing, armature 1 continues to pivot about fulcrum P during printing operations because the recess 12 does not contact the corner 42. The fact that fulcrum P, rather than corner 42, serves to pivot armature 1, even after heating has caused surface 41 of core 4 to rise above the level of surface 21, assures consistent uniformity in character formation throughout a lengthy document by avoiding timing variations during printing. This feature also eliminates a source of armature and core wear and degradation.

Figure 4:
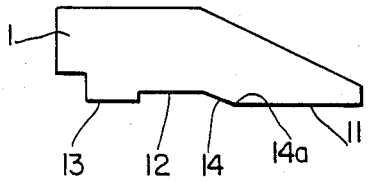
FIG. 4 is a side elevational view of an armature of an alternate embodiment.

Although the invention has been described in its preferred form, the described embodiment is not exclusive, and various changes and modifications may be imparted thereto. For instance, the shape of the armature 1 may be changed in particular applications, as shown in FIG. 4. The side wall 14 of the recess is inclined; in other words, the recess 12 is connected with the magnetic surface 11 by surface 14 with rounded surface **14*a* between surfaces 11 and 14. According to this example, the armature 1 contacts the magnetic surface 41 through surface contact, not through edge contact. The advantage is that both surface 11 and 41** are prevented from wearing.

It will be understood that the shape of the recess, a cross section shape of a core, and the armature may be changed variously in other embodiments.

In another modification, the wire stylus is fixed directly to the end of the armature but without a lever member. In this case, the length of the armature is increased to equal the length of the lever member.

In another embodiment, the printing mechanism of the present invention may be applied not only to a wire matrix printing head but also to an impact type printer. For instance, an impact line printer may be constructed by arranging a plurality of above armature actuating mechanisms in serial, facing a letters drum on a line printer to selectively hit a print hammer.

We claim:

1. A wire matrix printing mechanism, comprising:

a magnetic member having a cantilevered unitary body with a distal end supporting a stylus and an opposite end having resilient means for storing potential energy, a first member exterior surface coextensive with said distal end, a second member exterior surface, and a third member exterior surface coplanar with said first member surface, said third member surface providing a predetermined fulcrum, and said second member surface forming a recess into the unitary body distinct from said first and third member surfaces, said second member surface extending across the width of said magnetic member and separating said first member surface from said third member surface, said magnetic member being rotatable about said fulcrum;

first magnetic means including a yoke providing an exposed surface engaging said third member surface, for generating a force for rotating said magnetic member to store potential energy in said resilient means;

second magnetic means including a core having a first magnetic surface coplanar with said exposed surface and directly facing said first member surface, and a coil around an arm of the core providing said first magnetic surface, for rotating said magnetic member by cancelling the force generated by said first magnetic means and releasing stored energy in said resilient means, said core further having a corner at an end portion of said first magnetic surface most proximate said fulcrum;

said magnetic member having a cross-sectional area taken transversely to the plane of said first member surface at a junction between said first and said second member surfaces that is greater in area than the area of said first member surface; and said first member surface engaging the first magnetic surface of the core when said magnetic member is in a first operational state wherein the potential energy is stored in said resilient means, and said second member surface facing and directly overlying but not touching the coil, the corner and a corner area of the first magnetic surface of the core adjoining the corner such that during a return rotation of the magnetic member about said fulcrum to said first operational state from a printing operation, engagement between said corner, said corner area and said magnetic member is prevented.

2. An armature actuating mechanism, comprising:

a magnetic member having a cantilevered distal end and an opposite end portion having resilient means for storing potential energy, a first member exterior surface substantially coextensive with and forming one side of the distal end of said magnetic member disposed to support a distally extending element, a second member exterior surface recessed from said first member surface, and a third member exterior surface displaced from said second member surface and providing a predetermined fulcrum, said first and said third member surfaces being in a common plane and said second magnetic surface being recessed into the body of said magnetic member and away from said common plane, and the magnetic member being rotatable about the fulcrum;

permanent magnetic means having an exposed surface, for generating a force for attracting and rotating said magnetic member to store energy in said resilient means;

an electro-magnet including a core having a first magnetic surface directly facing said first member surface including a corner closest to said fulcrum, and a coil around an arm of the core providing said first magnetic surface, for canceling the force generated by the permanent magnetic means to release said stored potential energy of said resilient means and rotate said magnetic member;

said third member surface engaging said exposed surface and said first member surface engaging the first magnetic surface of the core for completing a magnetic circuit including said magnetic member, said permanent magnetic means, and said electro-magnet when said magnetic member is in a first operational state wherein potential energy is stored in said resilient means, and said second member surface facing and directly overlying but not touching the coil, the corner, and an area of the first magnetic surface of the core adjoining the corner, both during rotation of the magnetic member about said fulcrum and while said magnetic member is in the first operational state such that engagement between said corner, said corner area and said magnetic member is prevented.

3. The armature actuating mechanism according to claim 2, wherein said electro-magnet exposes said corner to said second member surface, further comprising said third member surface engaging the exposed surface of the permanent magnetic means and said fulcrum being formed by engagement of the magnetic member with the exposed surface.

4. The armature actuating mechanism according to claim 3, wherein said first magnetic surface of the core and the exposed surface are in a second common plane.

5. The armature actuating mechanism according to claim 3, wherein said second member surface is positioned between said first member and third member surfaces.

6. The armature actuating mechanism according to claim 2, wherein said first magnetic surface of the core has a wedge shape.

7. The armature actuating mechanism according to claim 2, further comprising a yoke mounted adjacent to said permanent magnet means, said yoke having a second magnetic surface facing said magnetic member and forming said exposed surface, and said third member surface engaging the second magnetic surface to form the fulcrum.

8. The armature actuating mechanism according to claim 7, wherein said first magnetic surface of the core and the second magnetic surface of the yoke are in a common plane when the electro-magnet has not been actuated over a substantial period of time.

9. The armature actuating mechanism according to claim 7, wherein said first magnetic surface of the core has a wedge shape and said second member surface faces an edge of the first magnetic surface nearest to the fulcrum.

10. The armature actuating mechanism according to claim 7, wherein said second member surface is positioned between said first member and third member surfaces and recessed into the body of said magnetic member and away from the first member surface.

11. An armature actuating mechanism, comprising:

a magnetic member rotatable about a predetermined fulcrum, said magnetic member having a body with:

a first portion including a first member surface coextensive with and forming one side of a distal end of said magnetic member disposed to support a distally extending element, a second portion adjoining said first portion and providing a second member surface recessed into the body of the magnetic member and displaced from said first member surface, and a third portion adjoining said second portion and providing a third member surface displaced from and disposed outwardly in the body from said second member surface, said first and said third member surfaces being in a common plane, said third portion being separated from said first portion by said second portion, and providing said predetermined fulcrum;

resilient means for storing potential energy fixed to said magnetic member body;

permanent magnetic means for generating a force for attracting and rotating said magnetic member about said fulcrum to store potential energy in said resilient means;

electro-magnet means including a core having a first magnetic surface disposed to directly face said first member surface and a part of said second member surface closest to said first portion, and a coil wound around an arm of the core providing said first magnetic surface, for counteracting force generated by the permanent magnetic means to release stored energy in said resilient means;

said third member surface engaging said permanent magnetic means and said first member surface engaging the first magnetic surface of the core when said magnetic member is in a first operational state of rotation, and said second member surface being displaced from said first member surface in a direction longitudinally away from a corner of said first magnetic surface nearest to said fulcrum;

whereby when said magnetic member is in the first operational state of rotation, said second member surface faces and directly overlies but does not touch the coil, the corner and an area of the first magnetic surface of the core directly facing said second member surface and adjoining the corner, and further whereby said first member surface does not contact said corner and said area.

12. The armature actuating mechanism according to claim 11, further comprising said permanent magnetic means having an exposed surface facing said third member surface of said magnetic member, said third member surface engaging the exposed surface of the permanent magnetic means and said fulcrum being formed by engagement of the magnetic member with the exposed surface.

13. The armature actuating mechanism of claim 12, wherein said first magnetic surface of the core and the exposed surface lie in a second common plane when the electro-magnet means has not been actuated over a substantial period of time.

14. The armature actuating mechanism of claim 13, wherein a cross-sectional area of said body through the second portion in a plane transverse to said first member surface is greater than the area of said first member surface engaging said first magnetic surface of the core.

15. The armature actuating mechanism of claim 11, further comprising:

said permanent magnetic means including a yoke and a permanent magnet, said yoke being mounted adjacent to said permanent magnet having a second magnetic surface facing said third member surface, and said third member surface engaging the second magnetic surface to form the fulcrum.

16. The armature actuating mechanism of claim 15, wherein said first magnetic surface of the core and the second magnetic surface of the yoke are in a second common plane when the electro-magnet means has not been actuated over a substantial period of time.

17. The armature actuating mechanism of claim 15, wherein said first magnetic surface of the core has a wedge shape and said second member surface faces said corner of the first magnetic surface nearest to the fulcrum.

18. The armature actuating mechanism of claim 15, wherein a cross-sectional area of said body through the second portion in a plane transverse to said first member surface is greater than the area of said first member surface engaging said first magnetic surface of the core.

* * * * *